United States Patent [19]

McGinley

[11] Patent Number: 4,881,466

[45] Date of Patent: Nov. 21, 1989

[54] HIGH VELOCITY SABOT FOR SPIN STABILIZED PENETRATOR

[75] Inventor: Jeremiah E. McGinley, Essex Junction, Vt.

[73] Assignee: General Electric Company, Burlington, Vt.

[21] Appl. No.: 288,939

[22] Filed: Dec. 23, 1988

[51] Int. Cl.[4] ..... F42B 13/16

[52] U.S. Cl. ..... 102/522

[58] Field of Search ..... 102/520–523

[56] References Cited

U.S. PATENT DOCUMENTS

| | | | |
|---|---|---|---|
| 620,400 | 2/1899 | Ahrens | 102/522 |
| 3,359,905 | 3/1966 | Engel | 102/93 |
| 3,496,869 | 7/1967 | Engle | 102/93 |
| 3,714,900 | 2/1973 | Feldman | 102/93 |
| 4,776,280 | 10/1988 | Burri et al. | 102/523 |

FOREIGN PATENT DOCUMENTS

| | | | |
|---|---|---|---|
| 123501 | 2/1919 | United Kingdom | 102/522 |

*Primary Examiner*—Harold J. Tudor

*Attorney, Agent, or Firm*—Bailin L. Kuch

[57] ABSTRACT

An assembly of a sabot is provided having a plurality of slots to divide the sabot into a like plurality of petals, each slot terminating in notch, and a base having a like plurality of lugs, each lug adapted to mate with a respective notch. The torque transmitting interface between each mated lug and notch is a flat plane extending longitudinally and chordally.

4 Claims, 3 Drawing Sheets

HIGH VELOCITY SABOT FOR SPIN STABILIZED PENETRATOR

FIELD OF THE INVENTION

This invention relates to an assembly of a spin stabilized projectile and a sabot to be fired from a gun at a relatively high velocity.

BACKGROUND OF THE INVENTION

Such assemblies, sometimes called discarding sabot, spin stabilized projectiles, or spin stabilizing armor piercing discarding sabots, are shown, for example, in U.S. Pat. No. 3,714,900, issued Feb. 6, 1973; U.S. Pat. No. 3,359,905, issued Dec. 26, 1967; U.S. Pat. No. 3,496,869 issued Feb. 24, 1970; and U.S. Pat. No. 4,776,280 issued Oct. 11, 1988.

Many of these assemblies employ a threaded or "ringed" joint between the base (or "pusher plate") and the sabot. This threaded joint interferes with the free-flight dynamics of the segments (or "petals") of the sabot as the segments mutually separate, (i) thereby disturbing the free-flight of the base or the penetrator, (ii) thereby upsetting the initial interval of free-flight of the penetrator, (iii) thereby causing the penetrator to yaw; and (iv) thereby causing (a) dispersion in the respective trajectories of a series (or burst) of fired projectiles, and (b) possible shattering of each projectile upon impact with the target.

SUMMARY OF THE INVENTION

An object of this invention is to provide a means for coupling the base to the sabot with torque transfer and alignment, yet allowing each segment to separate from the sabot without interference with the base or the penetrator, thereby reducing projectile jaw and dispersion.

A feature of this invention is the provision of an assembly of a sabot having a plurality of slots to divide the sabot into a like plurality of petals, each slot terminating in notch, and a base having a like plurality of lugs, each lug adapted to mate with a respective notch. The torque transmitting interface between each mated lug and notch is a flat plane extending longitudinally and chordally.

BRIEF DESCRIPTION OF THE DRAWING

These and other objects, features and advantages of the invention will be apparent from the following specification thereof taken in conjunction with the accompanying drawing in which.

DETAILED DESCRIPTION OF THE INVENTION

The high velocity sabot is used to launch subcaliber, spin-stabilized projectiles. Common applications include the firing of kinetic energy penetrators wherein a high density projectile is launched from a larger diameter, rifled gun bore, and the launching of projectiles for high speed impact research.

The sabots described herein are subject to the conservation of angular momentum. The whole body of the sabot is composed of several symmetrical elements or segments which while in the gun barrel are rotated about the longitudinal axis of the bore of the barrel. The whole body angular momentum is provided by the spin imparted by the rifling of the barrel. Upon release from the radical constraints of the barrel, the sabot is instantly separated into controlled predefined geometric segments by the fracturing of the thin web sections connecting each by overstressing these sections by the centrifugal acceleration forces acting upon each segment. Each segment then assumes its own free flight motion from the momentum of the whole body sabot.

The unrestricted free flight motion of each segment is composed of two components: (i) an angular velocity about the center of gravity of the segment, commonly termed its "spin couple" and (ii) a linear velocity of the segment commonly termed its "moment of momentum." Note that the angular velocity of the "spin couple" of component (i) above is equal to the angular velocity of the whole body.

The purpose of the invention described herein is to provide unrestricted free flight of each segment by designing an interfacing joint, which does not restrict or interfere with the free flight motion of the segment, between the segment and penetrator or the segment and plug or base. Conventional designs which do not allow unrestricted segment free flight cause uncontrolled impulses to the penetrator from the sabot elements. These impulses impart uncontrolled lateral initial momentum to the initial free flight of the penetrator. This transferred uncontrolled lateral momentum to the penetrator produces undesired yaw, yaw rates and lateral velocities of the penetrator which contribute to in-flight yaw, dispersion, and increased drag of the penetrator.

Figure 1A:
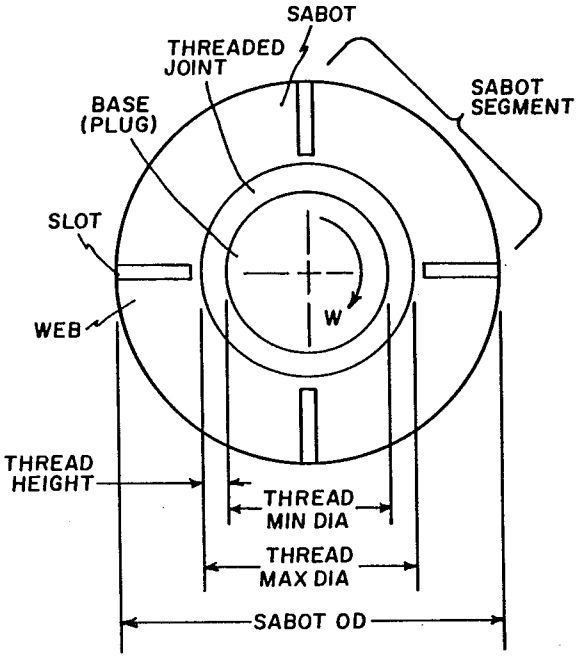
FIG. 1a (Prior Art)
FIGS. 1*a*, 1*b* and 1*c* are views in cross-section relating to conventional designs.
Figure 1B:
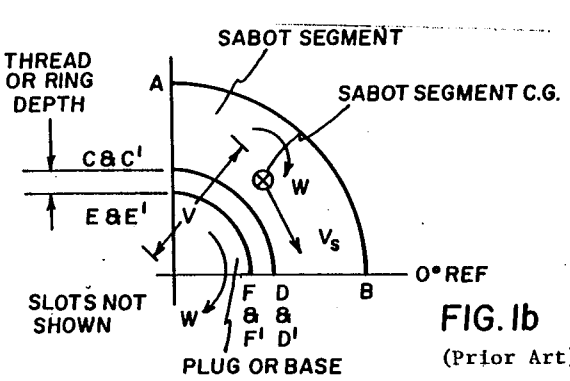
FIG. 1b (Prior Art)
Figure 1C:
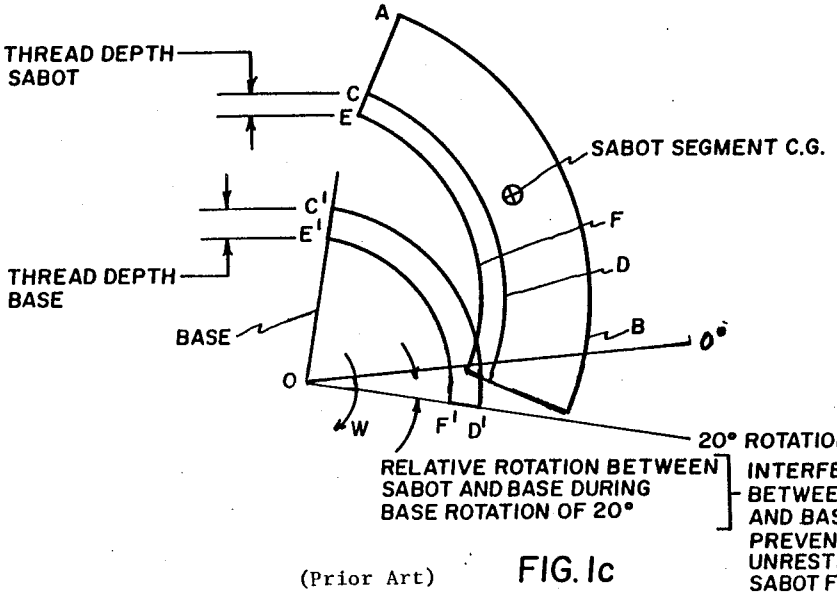
FIG. 1c (Prior Art)

One form of the one conventional design is a threaded joint between the base and sabot as shown in FIG. 8 of U.S. Pat. No. 3,714,900. The interference to unrestricted free-flight of each sabot segment of this design is illustrated in FIGS. 1*a*, 1*b* and 1*c*. FIG. 1*a* is a view in cross-section through the threaded joint and shows the whole body sabot having four segments in a threaded joint configuration before muzzle exit. The spin vector w is the angular velocity of the assembly imparted by the barrel rifling. FIG. 1*b* is a portion of FIG. 1*a* and shows one segment at the instant of web fracture before any relative motion between the base and segment. At this instant the sabot segment free flight has components w (spin couple) and a velocity $v_s$ (moment of momentum). Both components are about the sabot segment center of gravity. The base also has spin w. Points A, B, C, D, E, and F are on the sabot segment. Points C′, D′, E′ and F′ are on the base. Until exit from the muzzle, points C and C′, D and D′, E and E′, and F and F′ are coincident.

FIG. 1*c* shows the relative positions of the base and the sabot segment of FIG. 1*b* after a time interval corresponding to approximately twenty degrees of base rotation after web fracture. As shown, the combined angular and linear displacements (assumed to be free flight) of the sabot segment gives the relative rotation between base and sabot segment formed by the angle F-0-F′ over this interval. For a threaded joint this rotation tightens the joint contact. For an interference ring or plug joint this rotation produces contact forces attempting to establish F and F' coincidence. Either joint design clearly prevents the physical development of the spin couple from the sabot body to its segments. This uncontrolled loss produces a collapse of the natural sabot segment motion leaving its "moment of momentum" velocity vector $v_s$ to dominate. Each segment, now possessing different momentum, translates by $v_s$ to impact (or to miss due to a previous segment impacting) the penetrator, thereby transferring large lateral dynamics to the penetrator in its initial flight conditions.

Figure 2:
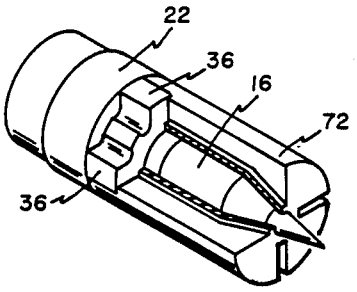
FIG. 2 is a perspective view of an assembly embodying this invention.
Figure 3:
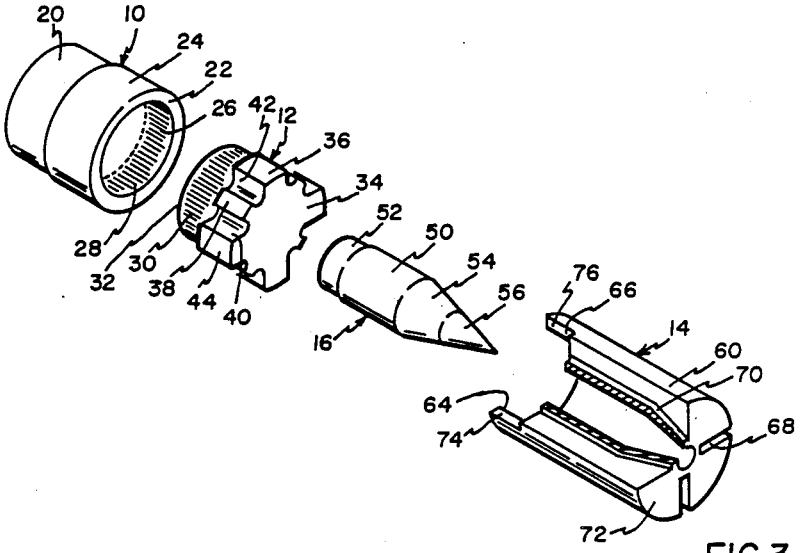
FIG. 3 is a perspective view of the assembly of FIG. 2 disassembled.
Figure 4:
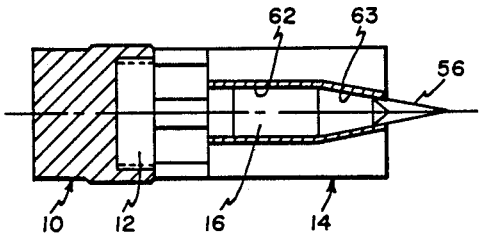
FIG. 4 is a view in elevation, in partial cross-section, of the assembly of FIG. 2.

As shown in FIGS. 2, 3 and 4, the embodiment includes a base subassembly comprising a pusher 10 and a plug 12, a sabot 14, and a penetrator 16.

The pusher 10, made e.g., of plastic, has an aft base portion 20 equal to gun bore diameter; and a forward annular portion 22 having an outer annular surface 24 larger than gun bore diameter and an inner annular surface 26 which has an annular row of longitudinally extending notches 28 of substantially "V" cross-section. The surface 24 serves as a rotating band and gas obturator and is engraved by the gun bore rifling.

The plug 12, made e.g., of aluminum, has an aft cylindrical portion 30, with an annular row of longitudinally extending lugs 32 of substantially "V" cross-section, which nests in and interlocks with the forward portion 22 of the pusher, and a forward cylindrical portion 34 having four lugs 36 radially extending from an intermediate cylindrical surface 38. Adjacent lugs define therebetween a respective notch in the body. Each lug has a pair of longitudinally extending, flat chordal surfaces 40 and 42 connected by a longitudinally extending cylindrical surface 44. Rotation of the pusher 10 caused by the rifling of the gun bore interacting with the rotating band 24 is transmitted to the plug 12 by their interlocked "V" lug and notch interface.

The penetrator 16, made e.g., of high density metal, has a cylindrical intermediate portion 50, an aft truncated conical portion 52, and a forward conical portion 54 having an intermediate conical portion of a relatively small included angle which terminates in a forwardmost conical portion of a relatively large included angle. The forward-most portion is surmounted by a plastic windscreen 56 which provides the forward conical portion 54 with a constant angular envelope.

The sabot 14 has a cylindrical body 60 with a cylindrical outer surface of the same diameter as the pusher aft portion 20. The body has an axial bore 62 with an aft portion which is cylindrical to receive the intermediate and aft portions of the penetrator and a forward portion 63 which is conical to receive the forward conical portion and the windscreen. The body has an aft annular recess 64 with four notches 66 through the side wall to receive the forward portion 34 of the plug with its four radially extending lugs 36. Adjacent notches 66 define therebetween a respective lug in the sabot. The body also has four slots 68. Each slot extends longitudinally from the forward transverse face of the body to the center of the respective notch 66, and radially outwardly from a residual web 70 of constant thickness about the axial bore 62. Adjacent slots 68 mutually define a petal 72. Each notch 66 has a pair of longitudinally extending, flat chordal surfaces 74 and 76 connected by a longitudinally extending inner cylindrical surface provided by the recess 64. The mutually interlocked lugs and notches serve to transmit torque from the plug to the sabot. Rotational torque for the penetrator 16 is provided by penetrator set-back inertia forces acting between the forward plug surface 34 and the rear mating base surface of the penetrator.

The conical portion 63 of the axial bore 62 of the sabot is used to furnish lateral support to the penetrator to minimize in-bore yaw or balloting.

The assembly may be held together, if desired, by any conventional means, e.g., adhesive or interlocking projections.

Upon firing, the assembly is accelerated forwardly with the rotating band 24 engaging the rifling of the gun bore and thereby the assembly is rotationally accelerated. Upon the assembly exiting the muzzle of the gun bore with an angular velocity w, the petals each have a longitudinally extending center of gravity which has a tangential velocity $v=rw$ and an own axis velocity w. The centripetal forces developed by these velocities cause the petals 72 to fracture at the web 70 and assume a non-interfering dynamic free flight condition, thereby eliminating any disturbance momentum to either the base or subcaliber projectile, to provide accurate free flight of the projectile.

Figure 5A:
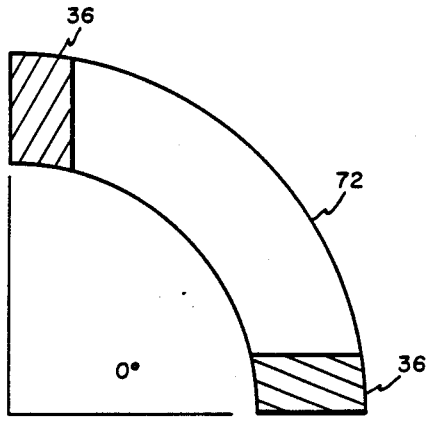
FIGS. 5*a*, 5*b*, 5*c*, 5*d*, and 5*e* are views in cross-section showing the separation of the assembly of FIG. 2.
Figure 5B:
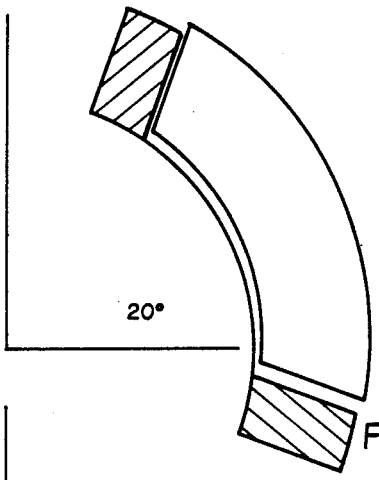
Figure 5C:
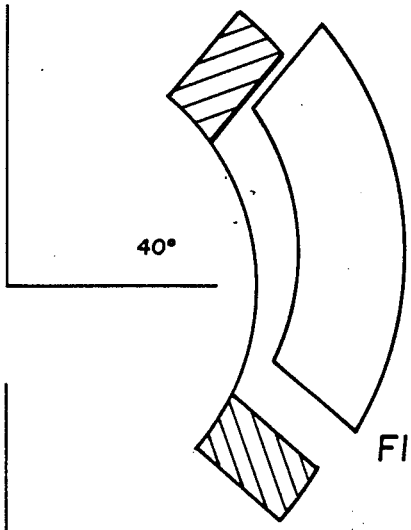
Figure 5D:
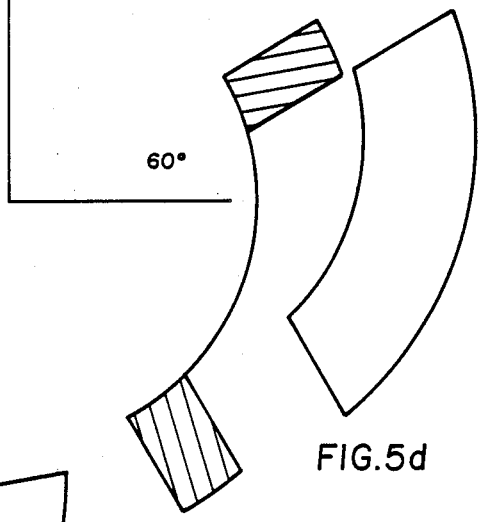
Figure 5E:
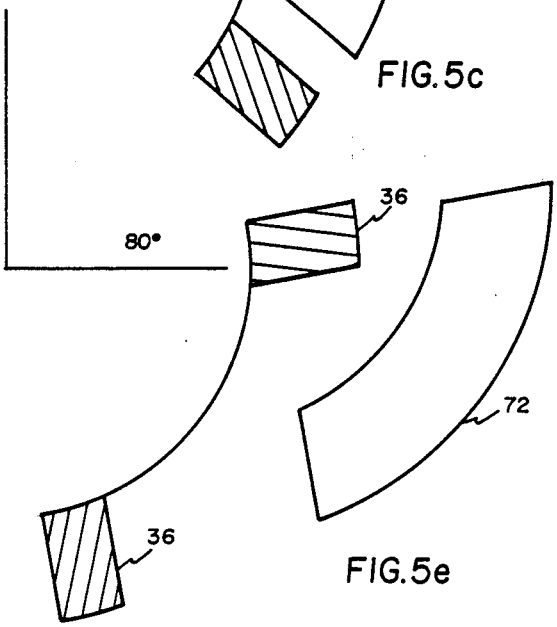

FIG. 5*a* shows one petal and the adjacent two lugs at the instant of the exit of the assembly from the muzzle, i.e., 0° of rotation of the assembly. FIG. 5*b* shows the petal 72 and lugs 36 at a time interval later defined by 20° of rotation of the assembly. FIG. 5*c* shows 40° of rotation. FIG. 5*d* shows 60° of rotation. FIG. 5*e* shows 80° of rotation. It will be seen that the petal progressively spaces itself away from the plug 12 with its lugs 36 without any mutual contact.

The embodiment shown has a male base section with four lugs forming 90° segments. This arrangement can be reversed with a female base section. Embodiments can also be made to work with three lugs, notches and petals of 120°. Dynamic interference with either the base and/or the penetrator occurs with the attempted use of two lugs and petals of 180° and six lugs and petals of 60°.

What is claimed is:

1. A sabot assembly, for launching a spin stabilized subcaliber projectile, from the bore of a gun barrel, comprising:

a one-piece-has sabot having a longitudinal axis;

a center, longitudinally extending bore for receiving the projectile;

a plurality of more than two longitudinally and radially extending slots, for, upon rupture, dividing the sabot into a like plurality of petals, each slot terminating in and centered on a respective notch, each pair of immediately adjacent notches defining a respective sabot lug;

a base having a cylindrical body having a rotating band, and a like plurality of lugs, each lug interfitted within a respective sabot notch;

each pair of immediately adjacent lugs defining a respective notch in said body, which is interfitted with a respective sabot lug;

each interfitted base lug and sabot notch having a sole torque transmitting interface which is a flat plane extending longitudinally and chordally.

2. A sabot assembly according to claim 1, for a projectile having a conical forward end, wherein:

said central bore has a conical forward end, whereby the projectile when disposed in said central bore, is captured longitudinally and radially between said base and said conical forward end of said bore; and the absence of torque transmitting interfaces other than said flat planes extending longitudinally and chordally, upon the exit of said sabot assembly from said gun barrel bore, allows said sabot to rupture into said petals, with said petals assuming respective trajectories without interference with the projectile.

3. A sabot assembly according to claim 1, wherein said plurality of longitudinal slots, notches and lugs is four in number.

4. A sabor assembly according to claim 1 wherein said plurality of longitudinal slots, notches and lugs is three in number.

* * * * *